US006401606B1

(12) United States Patent
Sato

(10) Patent No.: US 6,401,606 B1
(45) Date of Patent: Jun. 11, 2002

(54) STENCIL PRINTER

(75) Inventor: Mitsuo Sato, Miyagi (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 0 days.

(21) Appl. No.: 09/404,263

(22) Filed: Sep. 22, 1999

(30) Foreign Application Priority Data

Oct. 9, 1998 (JP) ..... 10-288178
Jun. 10, 1999 (JP) ..... 11-163188

(51) Int. Cl.[7] ..... B41L 13/00
(52) U.S. Cl. ..... 101/118; 101/116
(58) Field of Search ..... 101/118, 116, 101/115, 114

(56) References Cited

U.S. PATENT DOCUMENTS 3,572,240 A * 3/1971 Bohm ..... 101/189
4,864,368 A * 9/1989 Muramatsu ..... 355/309
5,102,112 A * 4/1992 Takahashi ..... 271/9
5,110,106 A * 5/1992 Matsummura et al. ..... 271/9
5,651,314 A * 7/1997 Gentle ..... 101/248
5,689,759 A * 11/1997 Isemura et al. ..... 399/45
6,073,925 A * 6/2000 Sato ..... 271/171
6,161,476 A * 12/2000 Yoneoka ..... 101/118

FOREIGN PATENT DOCUMENTS

JP 8-259008 10/1986
JP 5-124737 5/1993
JP 5-306025 11/1993
JP 6-293175 10/1994
JP 6-345281 12/1994
JP 9-104159 4/1997
JP 9-202032 8/1997
JP 10-1254 1/1998

* cited by examiner

*Primary Examiner*—John S. Hilten
*Assistant Examiner*—Anthony H. Nguyen
(74) *Attorney, Agent, or Firm*—Oblon, Spivak, McClelland, Maier & Neustadt, P.C.

(57) ABSTRACT

A stencil printer includes a multistage paper feeding device capable of selectively feeding different kinds of papers and an ink drum shiftable in a direction perpendicular to a direction of paper conveyance, i.e., in the widthwise direction of a paper. A paper is conveyed along a path coincident with a center line connecting the coincident centers of paper stocking portions included in the paper feeding device and the center of a paper discharge tray, so that the paper can be accurately conveyed without any skew. Further, side fences provided on the paper discharge tray are interlocked to each other and movable in the widthwise direction of a paper symmetrically with respect to the center line of the transport path, neatly laying the paper on the tray between the side fences. In addition, the ink drum shiftable in the above direction allows an image position to be adjusted without varying the paper transport path.

3 Claims, 10 Drawing Sheets

STENCIL PRINTER

BACKGROUND OF THE INVENTION

The present invention relates to a stencil printer and more particularly to a stencil printer of the type including a multistage paper feeding device capable of feeding papers of different kinds and an ink drum shiftable in the widthwise direction of the papers perpendicular to a direction in which the papers are conveyed.

A digital stencil printer is conventional which uses a laminate thermosensitive stencil made up of a thermoplastic resin film and a porous support adhered to each other. The printer includes a thermal head for selectively perforating, or cutting, the resin film of the stencil with heat in accordance image data. After the perforated stencil or master has been wrapped around an ink drum, ink feeding means arranged in the drum feeds an adequate amount of ink to the inner periphery of the drum. A press roller, press drum or similar pressing member presses a paper or similar recording medium against the ink drum so as to transfer the ink from the drum to the paper via the porous portion of the drum and the perforations of the master. As a result, an image represented by the image data is printed on the paper. Usually, a paper feeding device for continuously feeding papers one by one is built in the printer. The paper feeding device generally includes a feed tray to be loaded with a stack of papers and a pair of side fences for guiding the papers in the widthwise direction of the papers.

With the above printer, it is possible to shift the position of an image on the paper in the widthwise direction of the paper perpendicular to the direction of paper conveyance by shifting the feed tray of the paper feeding device in the widthwise direction. However, the adjustment of the shift relying on eyesight and the manual shift of the feed tray cannot easily implement delicate adjustment or accurate adjustment. In light of this, Japanese Patent Laid-Open Publication No. 5-306025, for example, discloses an arrangement for automatically shifting the feed tray of the paper feeding device.

To meet various kinds of needs, a stencil printer including a multistage paper feeding has recently been proposed. The multistage paper feeding device has a plurality of paper stocking portions and is capable of feeding papers of particular kind from each paper stocking portion. For such a multistage paper feeding device, Japanese Patent Laid-Open Publication No. 6-345281, for example, teaches an arrangement for automatically shifting a plurality of feed trays in the widthwise direction of the papers at the same time.

However, in any one of the conventional arrangements, a paper discharge tray for receiving papers, or printings, is not shiftable although the feed tray is shiftable. This brings about a problem that when the feed tray is shifted, the resulting printings cannot be accurately positioned on the discharge tray, and a problem that a pair of side fences on the discharge tray must be shifted independently of each other, obstructing easy operation. The arrangement taught in the above Laid-Open Publication No. 6-345281 has a drawback that a complicated construction is necessary for all of the feed trays to be shifted at the same time. Moreover, when the center of any one of the feed trays is deviated, the position of an image on a paper varies and must be adjusted every time the feed tray is selected.

To solve the above problems, Japanese Patent Laid-Open Publication No. 9-104159, for example, proposes an arrangement including a fixed feed tray and a fixed paper discharge tray and an ink drum shiftable in the widthwise direction of a paper and thereby allowing the position of an image to be adjusted. However, a stencil printer including both of an ink drum shiftable in the widthwise direction of a paper and a multistage paper feeding device has not been reported yet.

Today, a stencil printer is often operated with a large capacity paper feeding device, sorter, large capacity paper discharging device or similar peripheral unit connected thereto for meeting the demand for a great number of and various kinds of printings. Conventional peripheral units, however, lack an arrangement for shifting printings in the widthwise direction thereof, and each include a paper transport path arranged in a particular position. In practice, therefore, it is difficult to adjust the position of an image in the widthwise direction of a paper with the combination of a stencil printer and a peripheral unit.

Technologies relating to the present invention are also disclosed in, e.g., Japanese Patent Laid-Open Publication Nos. 5-124734, 9-202032, 10-1254, 8-259008 and 6-293175 and U.S. patent application Ser. Nos. 08/796,696 (pending) and Ser. No. 09/151,351 (pending).

SUMMARY OF THE INVENTION

It is therefore an object of the present invention to provide a stencil printer capable of adjusting, with a simple construction, the position of an image to be printed on a paper fed from any one of a plurality of paper stocking portions in the widthwise direction of the paper, and allowing a desired peripheral unit to be operatively connected thereto.

A stencil printer of the present invention includes a multistage paper feeding device having a plurality of paper stocking portions and capable of selectively feeding a plurality of different kinds of papers. An ink drum is shiftable in a direction perpendicular to a direction of paper conveyance and allows a master formed with an image to be wrapped therearound. A paper discharge tray stacks the papers each carrying a printed image thereon. The paper stocking portions each include at least a pair of side fences for positioning the papers in the widthwise direction of the paper. The paper discharge tray includes at least a pair of side fences for positioning the papers carrying printed images thereon in the widthwise direction of the paper. The paper stocking portions and paper discharge tray are arranged in the printer with center lines thereof coinciding with the center line of the paper transport path. The side fences of the paper discharge tray are interlocked to each other and movable in the widthwise direction of the paper symmetrically to each other with respect to the center line of the paper transport path.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

First, reference will be made to FIG. 1 for describing the general construction of the stencil printer in accordance with the present invention. As shown, the stencil printer includes a multistage paper feeding device A having a plurality of paper stocking portions T1 and T2 loaded with papers Pa and Pb, respectively. A printer body B includes an ink drum D shiftable in a direction D1 perpendicularly the direction of paper conveyance with a master M wrapped therearound. The papers or printings Pa or Pb are sequentially stacked on a paper discharge tray H. The paper socking portions T1 and T2 respectively include at least a pair of side fences F1 and at least a pair of side fences F2 for positioning the papers Pa and Pb in the widthwise direction. The paper discharge tray H includes at least a pair of side fences F3 for positioning the printings Pa or Pb in the widthwise direction and an end fence F4. The paper stocking portions T1 and T2 and paper discharge tray H each are formed with an engaging portion B2 engageable with a pin or similar positioning member B1 provided on the printer body B. After the engaging portion B2 has been engaged with the pin B1, the paper stocking portion of the paper discharge tray is fixed in place by screws B3. The center lines C of the paper stocking portions T1 and T2 and paper discharge tray H are aligned with each other, as illustrated. The side fences F3 of the paper discharge tray H are interlocked to each other and movable in the widthwise direction of the paper symmetrically with respect to the center line C of the tray H.

In the above construction, the centers of the papers Pa and Pb are coincident with the aligned center lines C of the stocking portions T1 and T2 and paper discharge tray H. Therefore, the papers Pa or Pb driven out of the printer body B to the tray H are neatly stacked between the side fences F3. Further, the ink drum D is movable in the direction D1 so as to adjust the position of an image without the paper transport path being varied.

Figure 2:
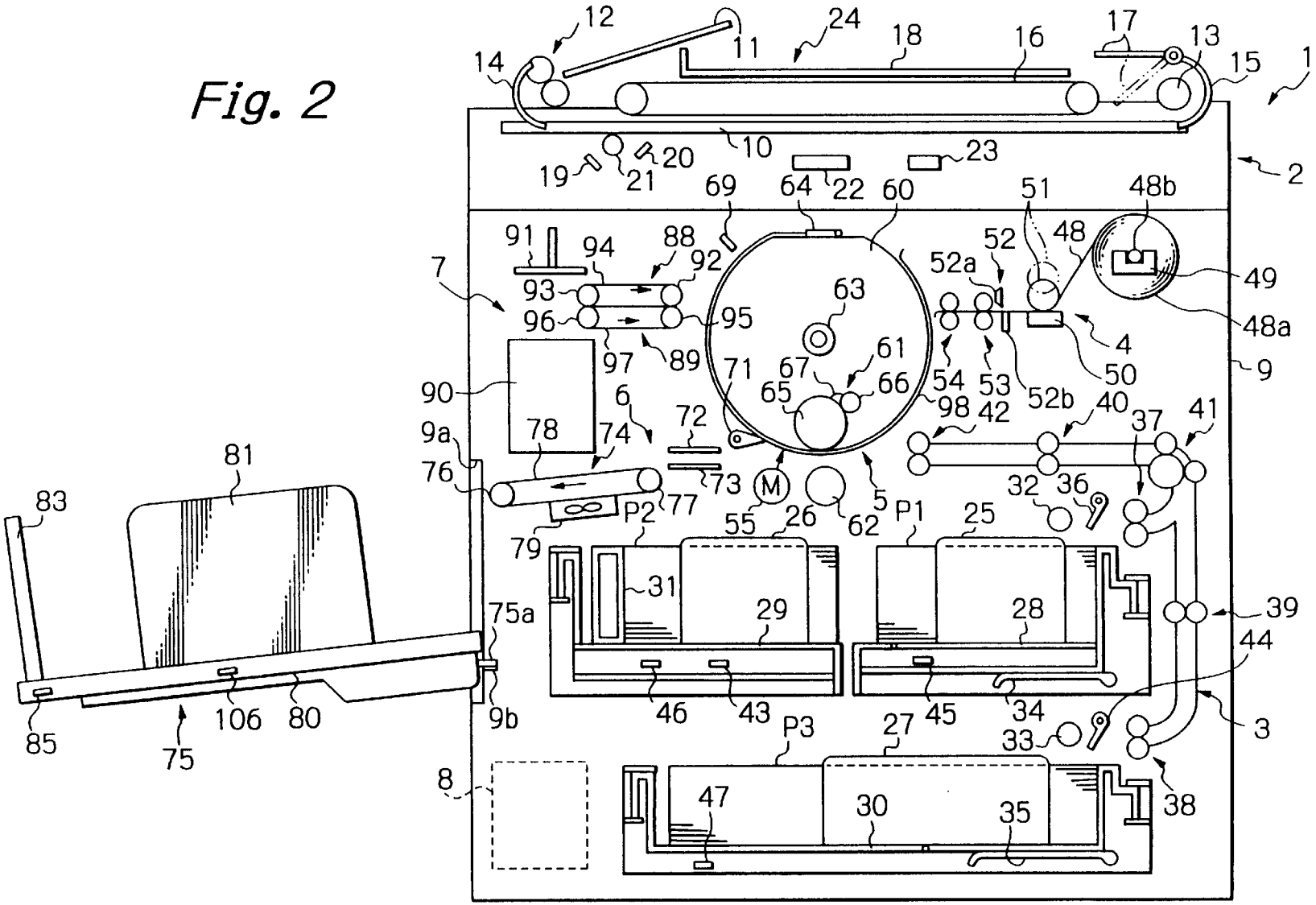
FIG. 2 is view showing a stencil printer embodying the present invention.

Referring to FIG. 2 of the drawings, a stencil printer embodying the present invention is shown and generally designated by the reference numeral 1. As shown, the stencil printer includes a casing 9 accommodating an image reading section 2, a paper feeding section or multistage paper feeding device 3, a master making section 4, a paper discharging section 6, a master discharging section 7, and a control section 8.

The image reading section 2 is mounted on the top of the casing 9 and includes a glass platen 10 on which a document is to be laid. A document feed tray 11 is used to lay a desired document or documents. A roller pair 12 and a roller 13 convey a document. Guides 14 and 15 respectively adjoin the roller pair 12 and roller 13 for guiding a document being conveyed. A belt 16 conveys a document along the glass platen 10. A flat direction selector 17 switches a direction in which a document read by the reading section 2 should be discharged. A document discharge tray 18 receives a document driven out via the direction selector 17. Mirrors 19 and 20 and a fluorescent lamp 21 scan a document. A lens 22 focuses the resulting reflection or image light to a CCD (Charge Coupled Device) image sensor or similar image sensor 23.

Among the above constituents of the image reading section 2, the document feed tray 11, roller pair 12, roller 13, guides 14 and 15, belt 16, direction selector 17 and document discharge tray 18 are mounted on a conventional cover plate, not shown, constituting an ADF (Automatic Document Feeder) unit 24. The ADF unit 24 may be angularly moved toward and away from the glass platen 10 by hand.

The paper feeding section or multistage paper feeding device 3 arranged in the lower portion of the casing 9 includes a first tray 28, a second tray 29 and a third tray 30 each constituting a paper stocking portion. The first and second trays 28 and 29 allow papers P1 and P2 of the same size to be stacked thereon. The third tray 30 allows papers P3 of relatively large size to be stacked thereon. A paper shifter 31 shifts the entire paper stack P2 from the tray 29 to the tray 28 when the papers P1 on the tray 28 are used up. Pick-up rollers 32 and 33 respectively feed the papers P1 and P3 one by one. Pressers 34 and 35 press the papers P1 and P3 against the pick-up rollers 32 and 33, respectively. Separation roller pairs 37 and 38 are respectively associated with the pick-up rollers 32 and 33, and each separate the top paper from the underlying papers. Additionally included in the paper feeding section 3 are a first paper sensor 36 for sensing the papers P1 pushed up by the presser 34 in contact with the papers P1, roller pairs 39 and 40 and a group of rollers 41 for conveyance, and a registration roller pair 42. The second tray 29 may be pulled out of the casing 9 while the printer 1 is in operation. This kind of configuration is taught in, e.g., Japanese Patent Laid-Open Publication No. 5-124737 mentioned earlier.

Figure 3:
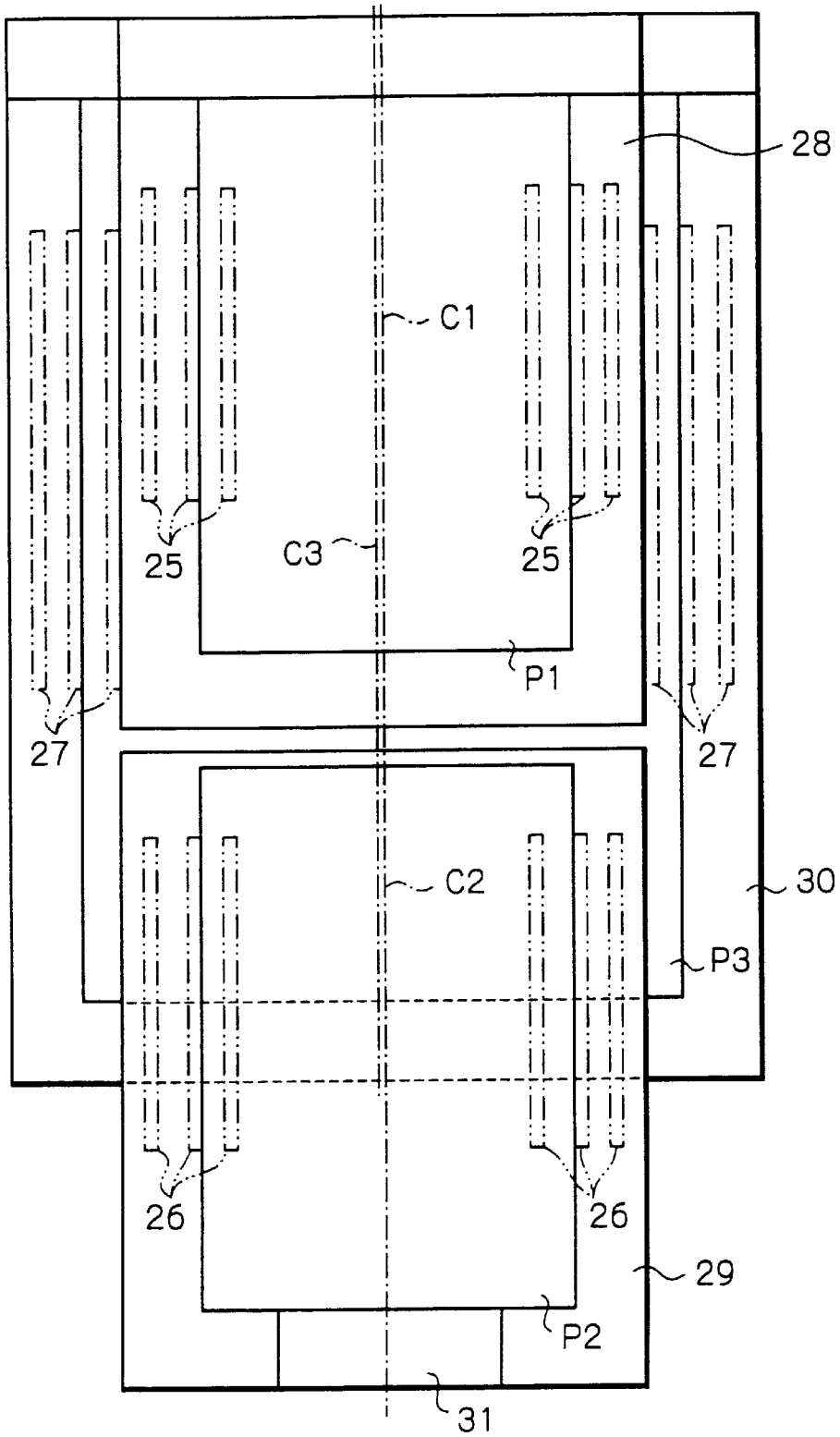
FIG. 3 is a view showing a paper feeding section included in the illustrative embodiment.

As shown in FIG. 3, the first to third trays 28–30 of the paper feeding section 3 have center lines C1, C2 and C3, respectively, coincident with each other; the center line C3 is intentionally shown as being deviated from the center lines C1 and C2 for the sake of illustration. For this purpose, the trays 28–30 each have the respective engaging portion, not shown, engaged with a positioning member, not shown, provided on the casing 9, as stated earlier. The trays 28–30 respectively include a pair of side fences 25, a pair of side fences 26 and a pair of side fences 27 for guiding the papers P1, P2 and P3 in the widthwise direction. The side fences 25–27 each are fastened to, inserted in or otherwise removably mounted to associated one of the trays 28–30. Each pair of side fences 25–27 are positioned at both sides of the center line C1, C2 or C3 and spaced by a distance corresponding to the size of the associated papers. It follows that the center lines of the papers P1–P3 stacked on the trays 28–30, respectively, are coincident with the center lines C1–C3, respectively. This is also true with the paper shifter 31, pickup rollers 32 and 33, pressers 34 and 35, separation roller pairs 37 and 38, roller pairs 39 and 40 and roller group 41 for conveyance, and registration roller pair 42. Let the coincident center lines C1–C3 be collectively referred to as a center line C hereinafter.

A first paper size sensor or sensing means 45 is positioned below the first tray 28 for sensing the size of the papers P1. The paper size sensor 45 is implemented by a plurality of conventional shield type sensors and determines the size of the papers P1 on the basis of the number of sensors shielded by the papers P1.

A second paper sensor 43 and a second paper size sensor or sensing means 46 are arranged below the second tray 29 for sensing the presence and the size, respectively, of the papers P2 stacked on the tray 29. The paper sensor 43 is a conventional reflection type sensor and senses the papers P2 via a hole formed in the tray 29. The paper size sensor 46 is identical in configuration with the paper size sensor 45.

A third paper sensor 44 identical in configuration with the first paper sensor 36 is positioned above the third tray 30 for sensing the papers P3 stacked on the tray 30. A third paper size sensor or sensing means 47 identical in configuration with the first paper size sensor 45 is positioned below the tray 30 for sensing the size of the papers P3.

The master making section 4 arranged above the paper feeding section 3 includes a support member 49 supporting a stencil 48 in the form of a roll 48*a*. A thermal head 50 perforates, or cuts, the stencil 48 by heating it. A platen roller 51 presses the stencil 48 against the thermal head 50 while conveying the stencil 48. Cutting means 52 cuts the stencil 48 at a preselected length. Roller pairs 53 and 54 convey the stencil 48. The master making section 4 is constructed into a unit removable from the casing 9.

Specifically, the stencil roll 48*a* includes a core 48*b* rotatably supported by the support member 49. A stepping motor, not shown, causes the platen roller 51 to rotate while moving means, not shown, selectively moves the platen roller 51 to a first position indicated by a solid line in FIG. 2 or a second position indicated by a dash-and-dots line. At the first position, the platen roller 51 is pressed against the thermal head 50 by a preselected pressure. At the second position, the platen roller 51 is spaced from the thermal head 50. The cutting means 52 has a conventional configuration in which an upper edge 52*a* is rotatable or movable up and down relative to a lower edge 52*b*.

The printing section 5 is arranged at the left of the master making section 4, as viewed in FIG. 2. The printing section 5 includes an ink drum 60, ink feeding means 61 and a press roller 62. The ink drum 60 is made up of a hollow cylindrical, porous support member and a laminate of mesh screens covering the outer periphery of the support member and formed of resin or metal. The ink drum 60 is affixed to flanges, not shown, rotatably mounted on a shaft 63 which plays the role of an ink feed pipe at the same time. Drum drive means, not shown, causes the ink drum 60 to rotate in synchronism with the registration roller pair 42. The ink drum 60 is removably mounted on the casing 9. A damper 64 is mounted on the outer periphery of the ink drum 60 for clamping the leading edge of the perforated part of the stencil 48 (master 48 hereinafter). Opening/closing means, not shown, causes the damper 64 to open and then close when the ink drum 60 reaches a preselected angular position.

An image position adjusting mechanism (see Japanese Patent Laid-Open Publication No. 9-202032 or 9-104159 mentioned earlier), a drum position sensor 69 are arranged around the ink drum 60. The image position adjusting mechanism is driven by a motor 55 to shift the ink drum 60 in the axial direction of the shaft 63, thereby shifting an image to be printed on any one of the papers P1–P3 (collectively a paper P hereinafter) in the direction of paper conveyance and the widthwise direction of the paper. The drum position sensor 69 senses the position of the ink drum 60 in the above direction in terms of the displacement of the drum 60 from a preselected home position coincident with the center line C.

Ink feeding means 61 is disposed in the ink drum 60 and includes an ink roller 65 and a doctor roller 66 in addition to the shaft 63. The ink roller 65 is rotatably supported by side plates, not shown, affixed to the shaft 63. Drive transmitting means, not shown, including gears and a belt transfers a driving force to the ink roller 65 and causes it to rotate clockwise, as viewed in FIG. 2. The doctor roller 66 adjoins the ink roller 65 such that the outer periphery of the roller 66 is parallel to the outer periphery of the roller 65. The ink roller 65 and doctor roller 66 form a generally wedge-shaped ink well 67 therebetween. Ink in the ink well 67 is drawn out while passing through a gap between the two rollers 65 and 66, forming a thin film on the roller 65.

The press roller 62 is positioned beneath the ink drum 60 and supported by opposite side walls, not shown, of the casing 9 in such a manner as to be rotatable and angularly movable. A cam, for example, causes the press roller 62 to angularly move into and out of contact with the ink drum 60, although not shown specifically. A spring or similar biasing means, not shown, constantly biases the press roller 62 toward the ink drum 60. When the press roller 62 is moved away from the ink drum 60, locking means, not shown, locks the roller 62 in a spaced position shown in FIG. 1.

The paper discharging section 6 arranged at the left of the printing section 5, as viewed in FIG. 2, includes a peeler 71, guides 72 and 73, a conveyor 74, and an electrically driven rack for paper discharge 75. The peeler 71 peels off the paper or printing P wrapped around the ink drum 60. The peeler 71 is pivotally supported by the sidewalls of the casing 9 such that the edge thereof is movable toward and away from the ink drum 60. The guides 72 and 73 are affixed to the sidewalls of the casing 9 for guiding the printing P separated from the ink drum 60 by the peeler 71. The conveyor 74 is made up of a drive roller 76, a driven roller 77, an endless belt 78 passed over the two rollers 76 and 77, and a suction fan 79. While the suction fan 79 sucks the printing P onto the belt 78, the belt 78 is driven by the drive roller 76 to convey the paper P in the direction indicated by an arrow in FIG. 2.

The paper P conveyed by the conveyor 74 is discharged to the electrically driven rack 75. The rack 75 is removably mounted to a paper outlet 9*a* formed in the casing 9. The rack 75 includes a tray 80 to be loaded with the papers or printings P, a pair of side fences 81, and an end fence 83. The rack 75 locates each of the side fences 81 and end fence 83 at a particular position on the basis of a paper size signal output from the paper feeding section 3. The rack 75 has two positioning pins 75*a* capable of mating with two positioning holes 9*b* formed in the casing 9 in the vicinity of the paper outlet 9*a*. In this configuration, when the rack 75 is mounted to the casing 9, the center line of the rack 75 in the direction of paper conveyance coincides with the center lines C of the trays 28–30.

Figure 4:
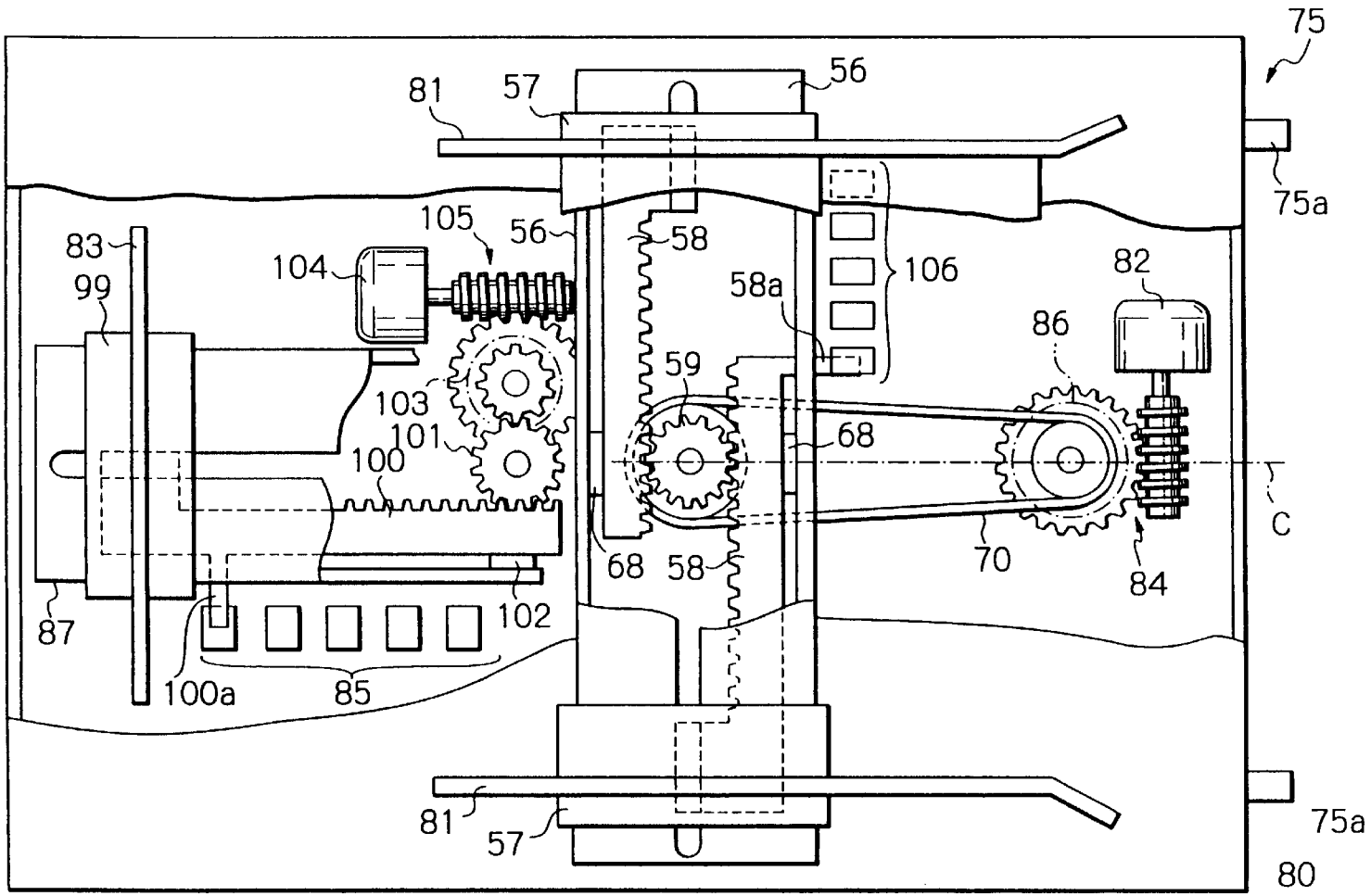
FIG. 4 is a partly taken away plan view of an electrically driven rack included in the illustrative embodiment.

As shown in FIG. 4, the above tray 80 has a generally box-like configuration. The side fences 81 each are mounted on a respective slider 57 slidable on and along guide rails 56 which are mounted on the tray 80. A rack 58 is mounted on the bottom of each slider 57. A pinion gear 59 is positioned on the centerline C of the tray 80 at the intermediate between the side fences 81. The surface of each rack 58 opposite to the surface meshing with the pinion gear 59 is slidably supported by a slide guide 68 mounted on the guide rail 56. A motor 82 drives a speed reduction mechanism or side fence moving means 84 including an electromagnetic clutch 86. The pinion gear 59 is operatively connected to the speed reduction mechanism 84 by a timing belt 70. When the motor 82 is energized and the electromagnetic clutch 86 is coupled, the side fences 81 are shifted toward or away from each other symmetrically with respect to the center line C, i.e., in the widthwise direction of the paper.

The end fence 83, like the side fences 81, is mounted on a slider 99 which is, in turn, slidable on a guide rail 87 disposed in the tray 80. A rack 100 is mounted on the bottom of the slider 99 and held in mesh with a gear 101. The surface of the rack 100 opposite to the surface meshing with the gear 101 is slidably supported by a slide guide 102 mounted on the guide rail 107. The gear 101 is operatively connected to a speed reduction mechanism 105 including an electromagnetic clutch 103 and driven by a motor 104. When the motor 104 is energized and the electromagnetic clutch 103 is coupled, the end fence 83 is shifted in the direction paper conveyance.

A side fence sensor 106 adjoins one of the racks 68 for sensing the position of the side fence associated with the rack 68. Likewise, an end fence sensor 85 adjoins the rack 100 for sensing the position of the end fence 83. The sensors 106 and 85, like the first paper size sensor 45, each is made up of a plurality of shield type sensors. Tongues 58*a* and 100*a* respectively extend out from the surfaces of the racks 58 and 100 opposite to the meshing surfaces. The position of the fence 81 or 83 is determined on the basis of the sensor shielded by the tongue 58*a* or 100*a,* respectively. This kind of sensing configuration is conventional.

The master discharging section 7 is located above the paper discharging section 6 and includes an upper discharge member 88, a lower discharge member 89, a box 90 for collecting used masters, and a compressor 91. The upper discharge member 88 is made up of a drive roller 92, a driven roller 93, and an endless belt 94 passed over the two rollers 92 and 93. The drive roller 92 rotates clockwise, as viewed in FIG. 2, causing the belt 94 to move in the direction indicated by an arrow. Likewise, the lower discharge member 89 is made up of a drive roller 95, a driven roller 96, and an endless belt 97 passed over the rollers 95 and 96. The drive roller 95 rotates counterclockwise, as viewed in FIG. 2 to move the belt 97 in the direction indicated by an arrow. Moving means, not shown, selectively moves the lower discharge member 89 to a position shown in FIG. 2 or a position where the circumference of the drive roller 95 contacts a used master 98 wrapped around the ink drum 60. Lowering means, not shown, selectively lowers the compressor 91 into the box 90 for compressing the used master 98 collected in the box 90. The two discharge members 88 and 89, box 90 and compressor 91 are constructed into a unit removable from the casing 9.

Figure 5:
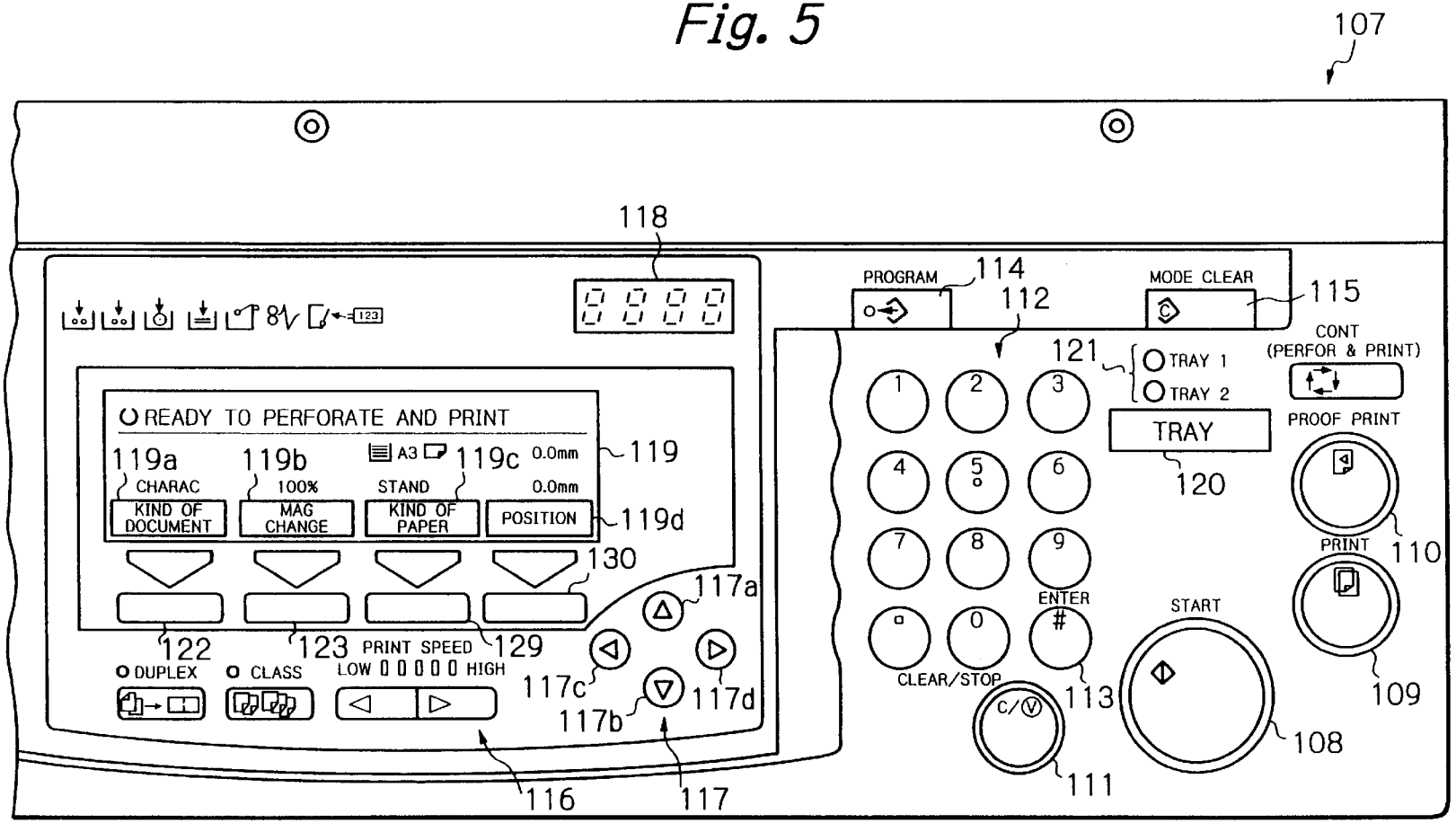
FIG. 5 is a plan view showing a specific configuration of a control panel included in the illustrative embodiment.

FIG. 5 shows a specific arrangement of a control panel 107 mounted on the front part of the top of the stencil printer 1. As shown, the control panel 107 includes a perforation start key 108 for starting a master making operation, a print start key 109, a proof print key 110, a clear/stop key 111, numeral keys 11, an enter key 113, a program key 114, a mode clear key 115, print speed keys 116, image position keys 117, a display 118 implemented by seven-segment LEDs (Light Emitting Diodes), a display 119 implemented by an LCD (Liquid Crystal Display), a tray key 120 for selecting either Tray 1 (first tray 28) or Tray 2 (third tray 30), and tray indicators 121 implemented by LEDs each for indicating a particular tray selected on the key 120. The image position keys 117 are made up of an up key 117*a*, a down key 118*b,* a left key 117*c*, and a right key 117*d*. Operation commands input on the control panel 114 are sent to a control section 8, FIG. 2. The control section 8, in turn, sends display signals to the displays 118 and 119 and indicators 121.

As shown in FIG. 5, a picture initially appearing on the display 119 includes the kind of documents 119*a,* a magnification change ratio 119*b*, the kind of papers 119*c,* and position adjustment 119*d.* Keys 122, 123, 129 and 130 are respectively positioned below and associated with the above portions 119*a*–119*d.* The display 119 has a hierarchical configuration. When the key 122, for example, is pressed in the condition shown in FIG. 5, a document mode for setting the kind of documents is set. When the key 123 is pressed, a magnification change mode for inputting a desired magnification change ratio is set. Likewise, when the key 129 or 130 is pressed, a paper mode for inputting the kind of papers or an image position mode for adjusting an image position, respectively, is set.

Figure 6:
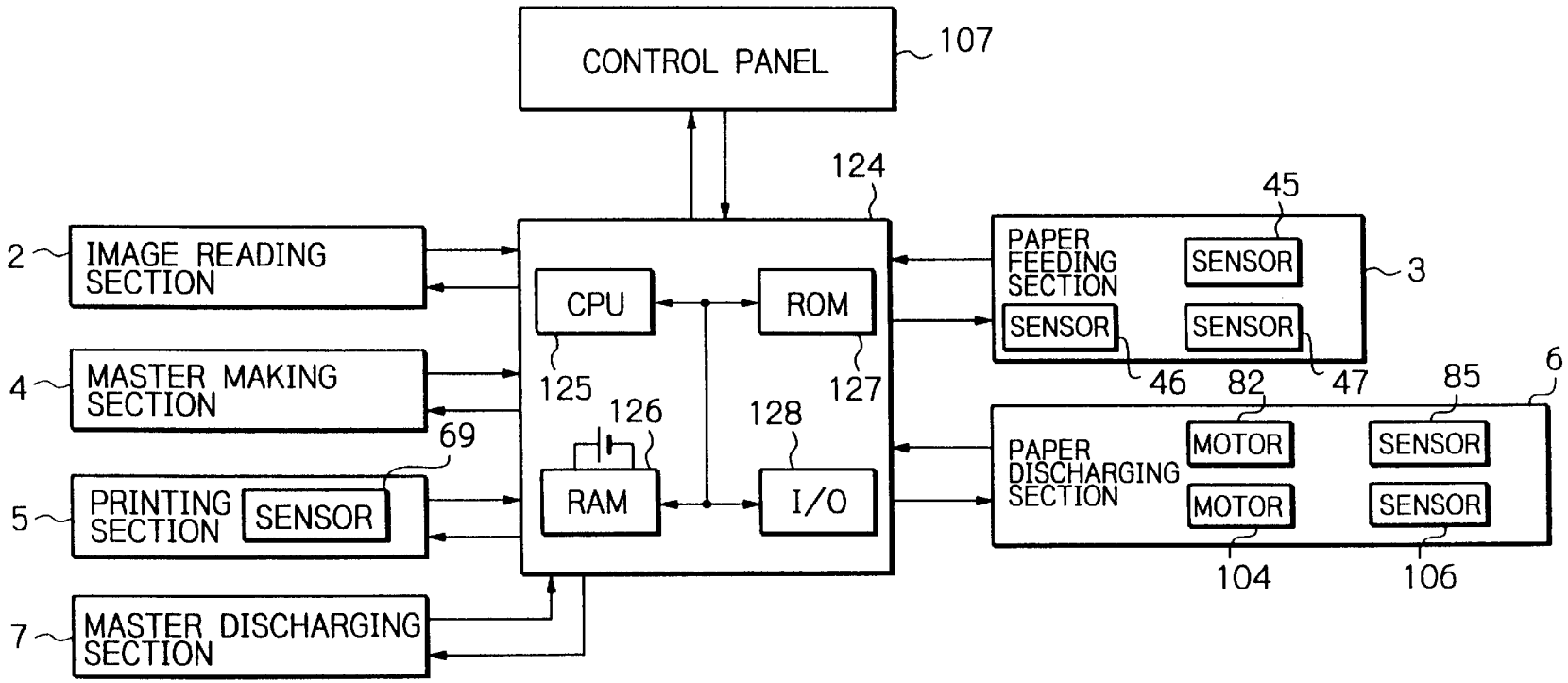
FIG. 6 is a block diagram schematically showing control means included in the illustrative embodiment.

FIG. 6 shows control means 124 constituting the major part of the control section 8, FIG. 2, disposed in the casing 9. As shown, the control means 124 is implemented by a conventional microcomputer including a CPU (Central Processing Unit) 125, a RAM (Random Access Memory) 126, a ROM (Read Only Memory) 127, and an I/O (Input/Output) expander 128. The control means 124 controls the entire printer 1.

The CPU 125 receives the output signals of the various sensors and control panel 107. The image reading section 2, paper feeding section 3, master making section 4, printing section 5, paper discharging section 6 and master discharging section 7 each are connected to the CPU 125 via a respective driver. The CPU 125 performs, based on a program stored in the ROM 127 beforehand, operations with the signals input from the sensors and control panel 107 and sends a particular control signal to the driver of each of the above sections 2–7. At the same time, the CPU 134 sends display signals to the control panel 114. The CPU 125 temporarily writes the program read out of the ROM 127 in the RAM 126. The program written to the RAM 126 may be rewritten via the control panel 107, as desired. More specifically, a plurality of different operation programs for operating the various actuators of the printer 1 are stored in the ROM 127.

The printer 1 having the above construction will be operated as follows. First, the operator of the printer 1 lays a desired document on the document feed tray 11 and selects desired papers P on the tray key 120 provided on the control panel 107. At this instant, one of the indicators 121 displays the tray selected. If desired, the operator may additionally select a character mode, photo mode or similar master making mode on the key 122 associated with the kind of document 119*a* of the display 119. Further, the operator may input a magnification change ratio on the key 123 associated with the magnification change ratio 119*b*, and the kind of papers, e.g., thick papers or thin papers on the key 129 associated with the kind of papers 119*c*.

Subsequently, the operator presses the perforation start key 108. In response, the image reading section 2 reads the document while sending an image data signal representative of the document to the control means 124. The control means 124 causes the presser 34 or 35 corresponding to the tray selected to raise the papers P1 or P3 until the top of the papers contacts the pick-up roller 32 or 33. At the same time, the paper sensor 36 or 44 senses the papers P1 or P3, respectively. If the papers P3 are absent, the control means 124 returns the presser 35 to the initial position shown in FIG. 2 while displaying the absence of the papers P3 on the control panel 107. When the papers P1 or P2 are absent, the control means 124 displays the absence on the control panel 107. Further, when the papers P1 are absent, but the papers P2 are present, the control means 124 returns the presser 34 to its initial position, moves the shifter 31 for shifting the papers P2 to the first tray 28, and displays the absence of the papers P2 on the control panel 107.

In parallel with the above operation of the paper feeding section 3, the control means 124 operates the paper discharging section 75, as follows. The side fences 81 and end fence 83 on the rack 75 each are brought to a particular home position and then moved to a position matching with the paper size sensed by the paper size sensor 45 or 47. In response to the resulting outputs of the fence sensors 85 and 106, the control means 124 positions the fences 81 and 83 and drives the suction fan 79.

The master discharging section 7 removes a used master 98 from the ink drum 60 in parallel with the operation of the image reading section 2. Specifically, drum drive means, not shown, causes the ink drum 60 with the used master 98 wrapped therearound to rotate counterclockwise, as viewed in FIG. 2. When the control means 124 determines that the trailing edge of the used master 98 has reached a preselected discharge position corresponding to the drive roller 95, the control means 124 causes the drive means and moving means to rotate the drive rollers 92 and 95 and move the lower discharge member 89 toward the ink drum 60. At the time when the drive roller 95 contacts the used master 98, the ink drum 60 is rotating counterclockwise. Therefore, the used master 98 picked up by the drive roller 95 is nipped by the upper discharge roller 89 and lower discharge roller 88 and peeled off from the drum 60 thereby. Thereafter, the used master 98 is conveyed to the box 90 by the discharge members 89 and 88 and compressed in the box 90 by the compressor 91.

After the used master 98 has been fully removed from the ink drum 60, the inkdrum 60 is further rotated to the previously mentioned master feed position. Subsequently, the control means 124 causes the opening/closing means to open the camper 64. In this condition, the ink drum 60 waits for a new master. This is the end of the master discharging operation.

The above master discharging operation is followed by a master making operation. When the ink drum 60 reaches its stand-by position for waiting for a master, the control means 124 energizes the stepping motor, not shown, for causing it to rotate the platen roller 51 and rollers 53 and 54. As a result, the stencil 48 is paid out from the roll 48*a* and perforated by the thermal head 50, as stated previously.

The perforated part of the stencil, i.e., the master 48 is conveyed toward the damper 64. When the control means 124 determines, in terms of the number of steps of the stepping motor, that the leading edge of the master 48 has reached a position where it is ready to be clamped by the damper 64, the control means 124 causes the opening/closing means to close the damper 64. The damper 64 therefore retains the leading edge of the master 48 on the ink drum 60.

Subsequently, the ink drum 60 is rotated clockwise, as viewed in FIG. 2, at a peripheral speed equal to the conveyance speed of the master 48, so that the master 48 is sequentially wrapped around the ink drum 60. When the control means 124 determines, in terms of the number of steps of the stepping motor, that a single master 48 has been completed, the control means 124 causes the platen roller 51 and roller pairs 53 and 54 to stop rotating. At the same time, the control means 124 causes the upper edge 52*a* to move relative to the lower edge 52*b* for thereby cutting off the master 48. The ink drum 60 in rotation pulls the cut master 48. When the ink drum 60 again reaches its circumferential home position, it is brought to a stop to end the master wrapping operation.

After the master 48 has been wrapped around the ink drum 60, a trial printing is produced, as follows. After the ink drum 60 has been stopped at the home position, the control means 124 causes the drum 60 to start rotating at a low speed and causes the pick-up roller 32 (or 33), separation roller pair 37 (or 38), rollers 39–41 to start rotating. The pick-up roller 32 (or 33) and separation roller pair 37 (or 38) cooperate to pull out the top paper P from the first tray 28 (or third tray 30). The registration roller pair 42 nips the leading edge of the paper P fed from the tray 28 (or 30). It is noteworthy that the paper P can be desirably conveyed without any skew because the center line of the above papers P coincident with the center lines C of the tray 28 (or 39) is coincident with the centers of the pick-up roller 32 (or 33), separation roller 37 (or 38), and rollers 39–40 and registration roller pair 42.

When the leading edge of the image area of the master 48 wrapped around the ink drum 60 reaches a position corresponding to the press roller 62, the control means 124 causes the registration roller pair 42 to start rotating and driving the paper P toward the gap between the ink drum 60 and the press roller 62. The control means 124 actuated the registration roller pair 42, as stated above, causes the locking means to unlock the press roller 62. As a result, the press roller 62 is angularly moved toward the ink drum 60.

The press roller 62 presses the paper P fed from the registration roller pair 42 against the master 48 existing on the ink drum 60. Consequently, the paper P and master 48 are pressed between the press roller 62 and the ink drum 60. Ink fed to the inner periphery of the ink drum 60 by the ink roller 65 penetrates through the porous support and mesh screens of the ink drum 60 and then fills the interstice between the ink drum 60 and the master 48. Finally, the ink is transferred from the ink drum 60 to the paper P via the perforations of the master 48.

The peeler 71 peels off the paper P carrying the ink thereon from the ink drum 60 while introducing it into the gap between the guides 72 and 73. The paper P is conveyed to the left, as viewed in FIG. 2, by the belt 78 while being held on the belt 78 by the suction of the suction fan 79. As a result, the paper or trial printing P is driven out to the tray 80. At this instant, because the center line of the printing P is coincident with the center line of the tray 80, the paper P can be desirably positioned between the side fences 81 after hitting against the end fence 83. On completing the above sequence of steps, the printer 1 waits for an actual printing operation.

In the above condition, the operator presses the proof print key 110. In response, another paper P is fed from the paper feeding section 3 and nipped by the registration roller pair 42 in the same manner as the first paper P. At the same time, the ink drum 60 is caused to rotate at a high speed at the same timing as in the trial printing procedure. The registration roller pair 42 drives the paper P toward the gap between the ink drum 60 and the press roller 62. The paper P is pressed against the master 48 present on the ink drum 60 by the press roller 62 with the result that the ink is transferred to the paper P for forming an image. Again, the peeler 71 removes the paper P from the ink drum 60, and the conveyor 74 conveys the paper P4 to the tray 80. As soon as the ink drum 60 is returned to the home position, the proof printing procedure ends. Again, the center of this paper P is coincident with the center line C connecting the center of the tray 28 (or 30) and that of the tray 80. This allows the paper P to be accurately conveyed without any skew and neatly laid on the tray 80 between the side fences 81.

The operator watching the above proof printing may adjust the printing speed or the image position on either one of the print speed keys 116 and any one of the image position keys 117 and produce another proof printing. If the proof printing is acceptable, the operator inputs a desired number of printings on the numeral keys 112 and then presses the print start key 109. As a result, the papers P are sequentially fed from the paper feeding section 3. At this instant, the motor 55 has shifted the ink drum 60 in the axial direction in order to adjust the position of an image on the paper P, maintaining the center of the paper P coincident with the center line C connecting the centers of the trays 28 and 30 and the center of the tray 80. It follows that the paper P is accurately conveyed without any skew and neatly laid on the tray 80 between the side fences 81.

How the image position keys 117 are used to adjust the position of an image on the paper will be described hereinafter. When the operator presses the key 130, FIG. 5, the mode for adjusting an image position is set up. As a result, a picture shown in FIG. 7 appears on the display 119 and includes the following: an image 143 representative of a paper, a mesh image 144 overlying the image 143 and representative of an image area to be printed, an amount of adjustment 145 in the top-and-bottom direction (direction of paper conveyance) with respect to a reference image position, an amount of adjustment 146 in the right-and-left direction (widthwise direction of a paper) with respect to the same, arrows 147 and 148 respectively associated with the amounts of adjustment 145 and 146, a portion 149 labeled "Cancel" for allowing the operator to restore the initial picture without any adjustment, a portion 150 labeled "Setting" for allowing the operator to store the adjusted image position and then restore the initial picture, and an arrow 151 indicative of "Paper Feed Direction". The relative position of the two images 143 and 144 is fixed.

Figure 7:
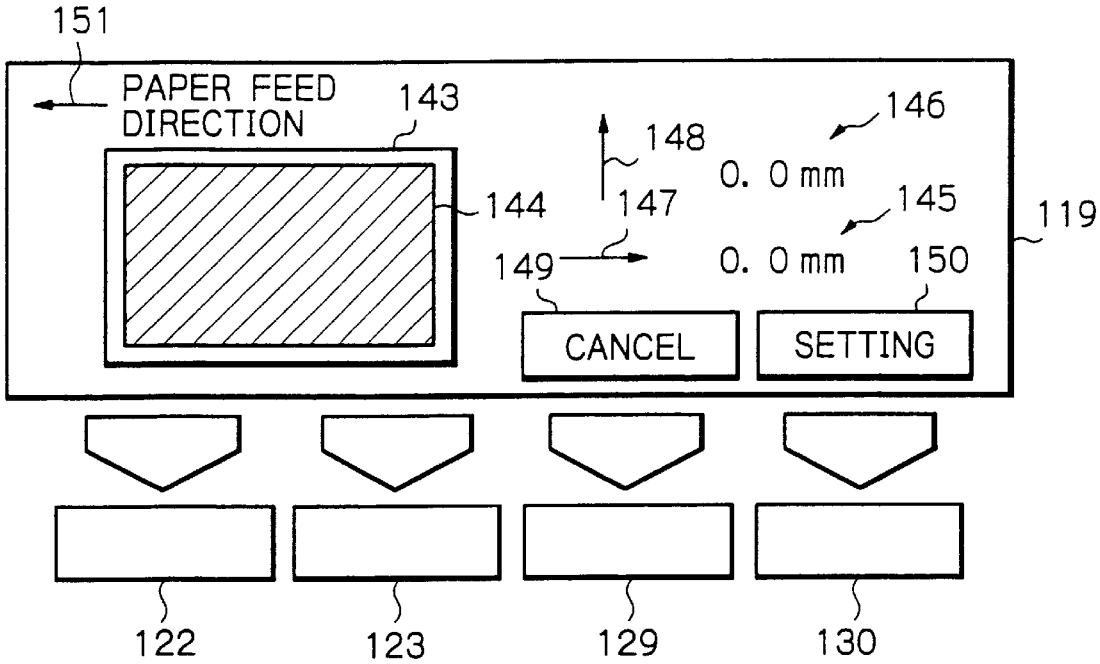
FIGS. 7 and 8 are views demonstrating a specific image position adjusting procedure available with the illustrative embodiment.

In FIG. 7, the keys 129 and 130 are respectively associated with the above portions 149 and 150, i.e., respectively used as a cancel key and a set key. At the time of power-up, the amounts of adjustment 145 and 146 in the to-and-bottom direction and right-and-left direction, respectively, both are zero representative of the reference position.

Figure 8:
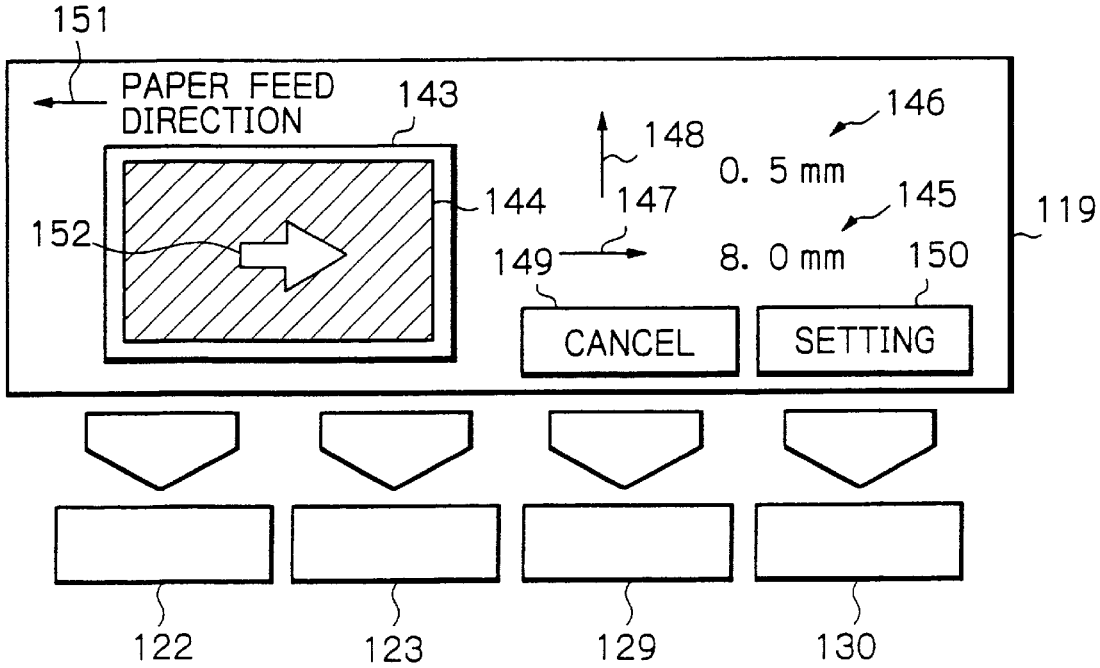

In the illustrative embodiment, the image position adjusting mechanism is operatively associated with the image position keys 117. Specifically, when any one of the keys 117 is pressed, the image position is shifted to a desired position by 0.5 mm at a time. As shown in FIG. 8, at the time of adjustment, the direction of shift of the key 117 pressed by the operator appears in the form of an outline arrow 152 at the center of the image 144 representative of the image area.

FIG. 8 shows a specific condition wherein the key 117*d* assigned to rightward shift is pressed while the desired amount of adjustment 145 in the top-and-bottom direction is 7.5 mm to 8.00 mm. The arrows 147 and 148 representative of the top-and-bottom shift and right-and-left shift, respectively, indicate the rightward direction and upward direction, respectively, as viewed in FIG. 8. The image is therefore shifted by 8.0 mm rightward (toward the bottom edge of a paper) and shifted by 0.5 mm upward (toward the right edge of a paper) from the reference position. The arrow 152 may appear only when the key 117 is being pressed or may appear when the key 117 is pressed and then disappear or blink on the elapse of a preselected period of time.

The operator selected a desired image position on the keys 117 presses the key 130. In response, information representative of the image position is sent to the control means 124. In response, the control means 124 causes the image position adjusting mechanism to shift the ink drum 60 to a position matching with the received information.

In the above embodiment, the speed reduction mechanisms 84 and 105 including the motors 82 and 104, respectively, move the side fences 81 and end fence 83, respectively. Of course, an arrangement may be made such that the side fences 81 and end fence 83 each are moved by hand. In such a case, a rack and pinion mechanism will be used to move the interlocked side fences 81 symmetrically with respect to the center line C in the widthwise direction of the paper.

In the illustrative embodiments, the side fences 25–27 each are mounted to the associated tray 28–30 by fastening or insertion. Alternatively, the above side fences 25–27, like the side fences 81, may be so arranged as to be movable in the widthwise direction of the paper symmetrically to each other with respect to the center lines C1–C3 via a rack and pinion mechanism. In such a case, a construction for automatic movement including drive means and a construction for manual movement not including drive means will be provided together.

Figure 9:
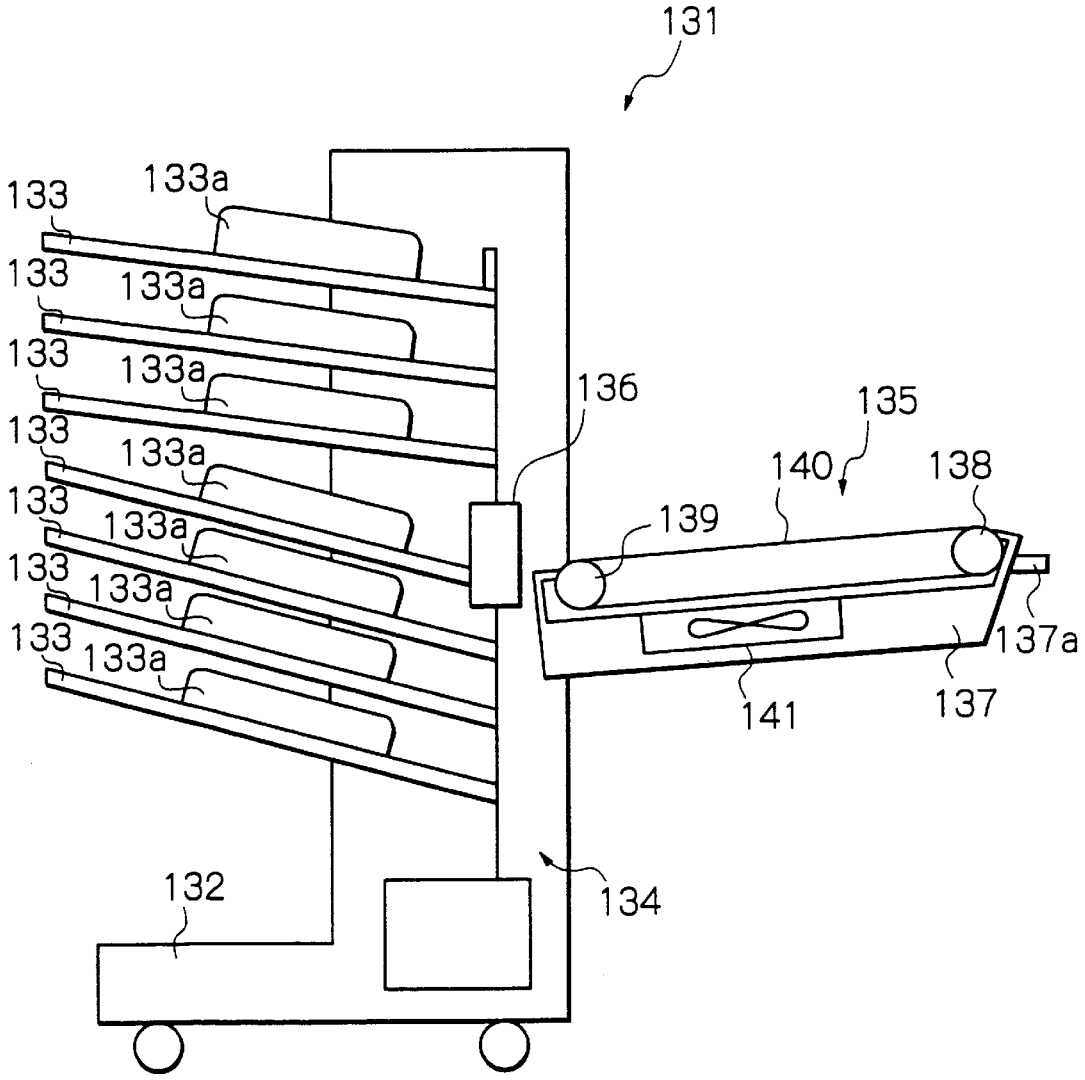
FIG. 9 is a view showing a sorter or peripheral unit applicable to an alternative embodiment of the present invention.

FIG. 9 shows a sorter belonging to a family of peripheral units and applicable to an alternative embodiment of the present invention. As shown, the sorter, labeled 131, is connected to the printer 1 in place of the electrically driven rack 75. The sorter 131 includes a sorter body 132, bins 133 movable up and down, a mechanism 134 for moving the bins 133 up and down, and a conveyor 135 for conveying the papers P sequentially driven out of the printer 1 toward the bins 133.

The bins 133 are supported by the sorter body 132 such that their centers in the widthwise direction of the paper are coincident in the up-and-down direction. Each bin 133 is bent substantially vertically upward at its upstream end in the direction of paper conveyance. A roller, not shown, is mounted on the underside of each bin 133. The lowermost bin 133 is affixed to a bracket, not shown, included in the mechanism 134. The uppermost bin 133 has its bent end extended more than the other bins 133 and serves as a non-sort tray. A pair of side fences 133*a* is provided on each bin 133 for guiding the paper P to be laid on the bin in the widthwise direction of the paper. The side fences 133*a*, like the side fences 81, are interlocked to each other and movable in the widthwise direction of the paper symmetrically with respect to the center line of the bin 133.

The mechanism 134 includes a lead cam 136 having a spiral groove in its circumference and drive means, not shown, in addition to the above bracket. When the roller of any one of the bins 133 is received in the groove of the lead cam 136, the cam 136 is rotated to move the bin 133 upward or downward. This kind of configuration of the mechanism 134 is conventional.

The conveyor 135 includes a conveyor body 137, a drive roller 138, a driven roller 139, a plurality of parallel endless belts 140 passed over the drive roller 138 and driven roller 139, and a suction fan 141 positioned below the belts 140. Two positioning pins 137*a* are studded on the end of the conveyor body 137 adjoining the printer 1. When the sorter 131 is mounted to the casing 9, the pins 137*a* are engaged with the positioning holes 9*b*, FIG. 2. In this condition, the center of each bin 133 in the direction of paper conveyance is coincident with the center lines C of the trays 28–30.

In this embodiment, too, the center of the paper P is coincident with the center line C connecting the centers of the trays 28 and 30 and the centers of the bins 133. It follows that even when a sort mode is selected, the paper P is accurately conveyed without any skew and neatly laid on the designated one of the bins 133 between the side fences 133*a*.

Of course, the sorter 131 may be replaced with any other suitable peripheral unit, e.g., a large capacity paper feeding device including a tray movable up and down or a large capacity paper discharging device also including a tray movable up and down. When use is made of a large capacity paper discharging device, positioning pins engageable with the holes 9*b*, FIG. 2, are studded on the device around a paper inlet in order to cause the center line of the device and the center lines C of the trays 28–30 to coincide with each other. Further, assume that the peripheral unit is implemented by a large capacity paper feeding device taught in Japanese Patent Laid-Open Publication No. 8-259008 mentioned previously. Then, the casing 9 is formed with a paper inlet and positioning holes at the right-hand side of the roller group 41 which the paper feeding device is provided with a pick-up roller and a separation roller. In this case, positioning pins engageable with the above positioning holes are studded on the feeding device in the vicinity of a paper outlet, so that the center line of the device in the direction of paper conveyance is coincident with the center lines C of the trays 28–30.

In the embodiments shown and described, the first to third paper feed trays 28–30 are respectively provided with a pair of side fences 25, a pair of side fences 26, and a pair of side fences 27. Likewise, the paper discharge tray 80 is provided with a pair of side fences 81. In addition, each bin 133 is provided with a pair of side fences 133*a*. If desired, the trays 28–30 and 80 and bins 133 each may be provided with two or more pairs of side fences, in which case all the side fences should be interlocked to each other and moved symmetrically with respect to the center lines of the trays 28–30 and bins 133 in the widthwise direction of the paper. For example, when one pair of side fences on one of the trays 28–30 and bins 133, the other pairs of side fences provided on the same tray or bin should be moved in interlocked relation to the above pair.

Figure 1:
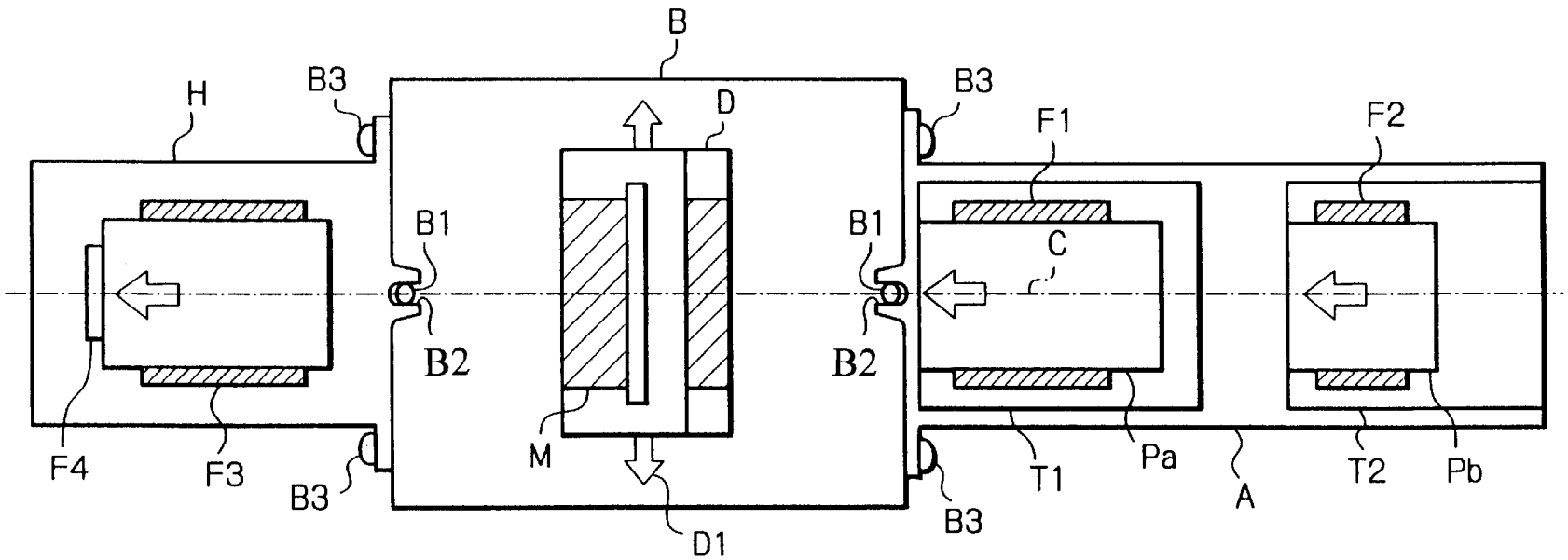
FIG. 1 is a view for describing the general construction of a stencil printer in accordance with the present invention.
Figure 10:
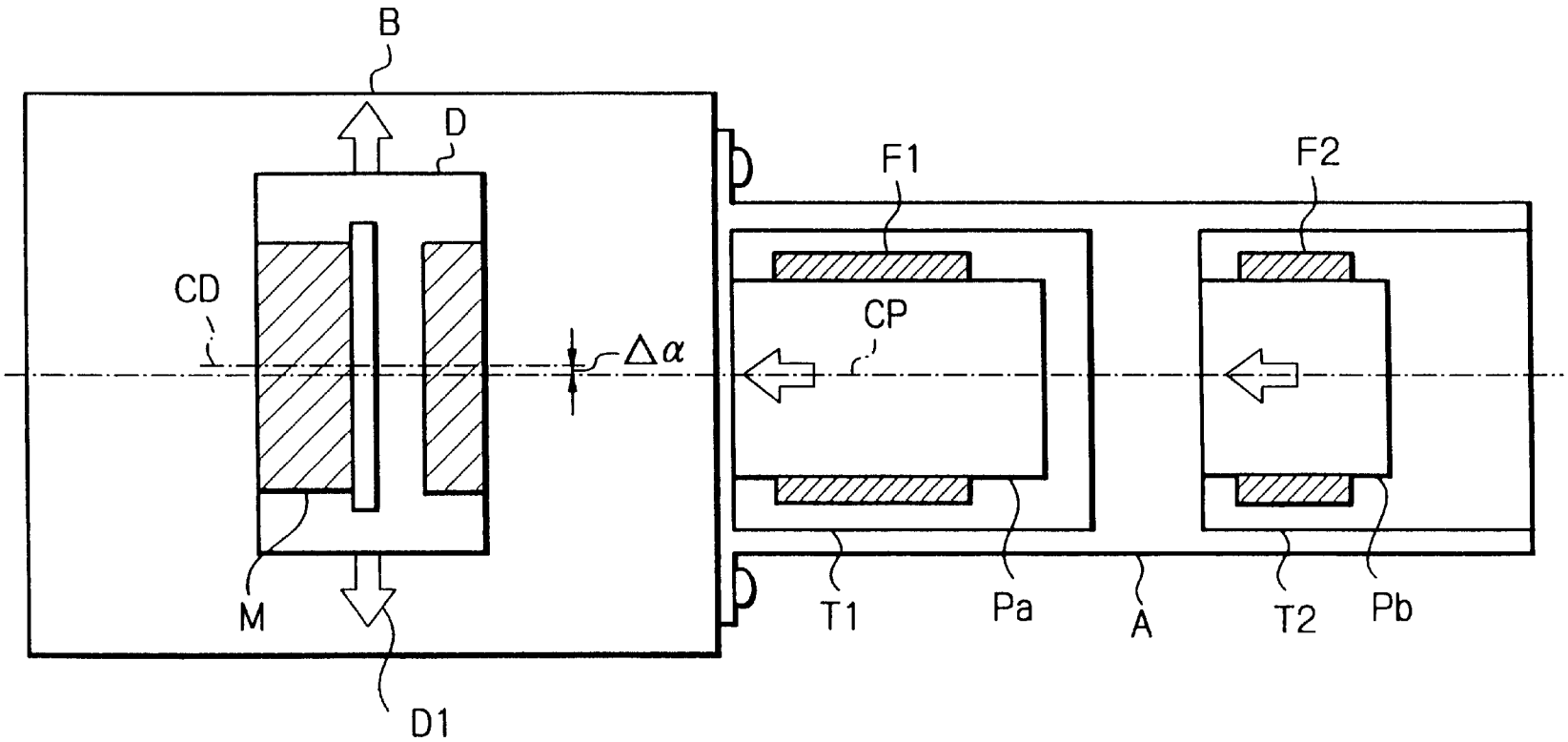
FIG. 10 is a view showing a modification of either one of the illustrative embodiments.

Now, as shown in FIG. 10 similar to FIG. 1, it may occur that the center line CP of the paper transport path and the center line CD of an image formed in the master M wrapped around the ink drum D which is held at its original position are deviated from each other by a distance $\Delta\alpha$. In FIGS. 1 and 10, identical references designate identical structural elements. The deviation $\Delta\alpha$ shown in FIG. 10 occurs, e.g., when the multistage paper feeding device A mounted on the printer body B is deviated from the printer body B, and would bring the center of a printed image out of coincidence with the center of a document image. In light of this, the illustrative embodiments may be modified to correct the deviation $\Delta\alpha$ by electrically shifting the original position of image-data stored in control means capable of electrically shifting the ink drum D in the widthwise direction of the paper. Such a modification will be described with reference to FIG. 11.

Figure 11:
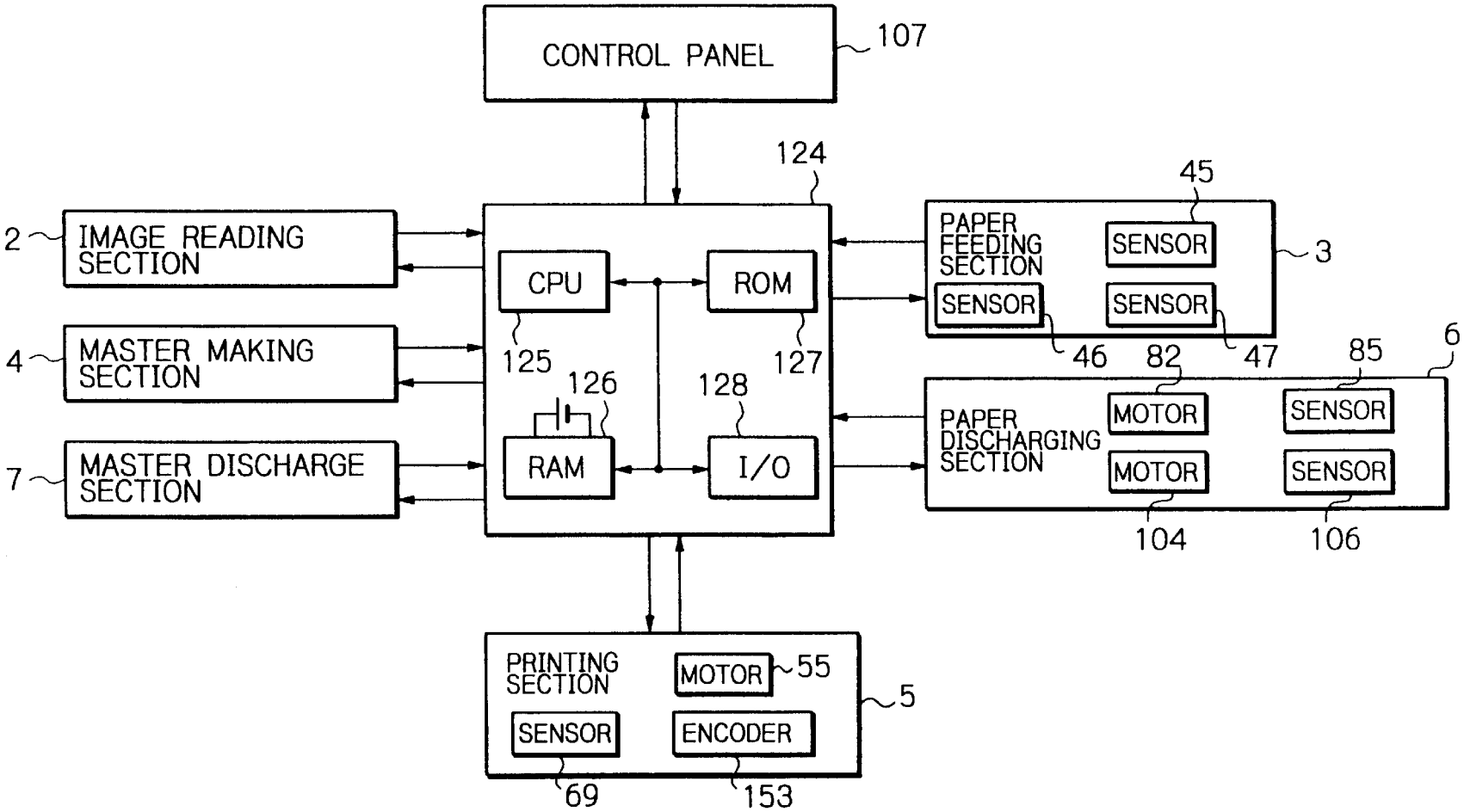
FIG. 11 is a schematic block diagram showing control means included in the above modification.

As shown in FIG. 11, the modification differs from the illustrative embodiments in that the printing section 5 additionally includes an encoder 153 for determining the displacement of the ink drum 60 in terms of the number of pulses. In the initial condition, the control means 124 drives the motor 55 in order to shift the ink drum 60 until the sensor 69 senses the drum 60 brought to the home position. Assume that when the ink drum 60 is brought to a stop at the home position, the center line CD of a printed image is deviated from the center line CP of the paper transport path by $\Delta\alpha$. Then, after the sensor 69 has sensed the ink drum 60 at the home position, the control means 124 further drives the motor 55. As soon as a number of pulses corresponding to the deviation, A a are output from the encoder 153, the control means 124 stops driving the motor 55, selects the resulting position of the motor 55 as a new home position, and sets zero as the amounts of adjustment 145 and 146, FIGS. 7 and 8.

More specifically, to correct the deviation $\Delta\alpha$, a printed image is measured, and then any one of the image position keys 117 is operated to bring the center line CP of an image to be perforated into accurate coincidence with the center line CP of the paper transport path. At this instant, the amount of adjustment 146 in the right-and-left direction displays a particular numerical value (corresponding to $\Delta\alpha$) other than 0.0 mm. However, only if particular keys, e.g., the enter key 113 and program key 114 are pressed in a preselected order meant for a serviceman, the above amount of adjustment 146 is replaced with 0.0 mm. This correction is not required thereafter. In this manner, the center of a document image and that of a printed image can accurately coincide with each other.

In summary, it will be seen that the present invention provides a stencil printer having various unprecedented advantages, as enumerated below.

(1) A paper is conveyed along a path coincident with a center line connecting the coincident centers of paper stocking portions and the center of a paper discharge tray, so that the paper can be accurately conveyed without any skew. Further, side fences provided on the paper discharge tray are interlocked to each other and move in the widthwise direction of a paper symmetrically with respect to the center line of the transport path, neatly laying the paper on the tray between the side fences. In addition, an ink drum is shiftable in the widthwise direction of a paper and allows an image position to be adjusted without varying the paper transport path.

(2) When a peripheral unit is operatively connected to the printer, the center line of a paper transport path included in the peripheral unit is brought into coincidence with the center line of the paper discharge tray. Therefore, the paper is free from skew during conveyance despite the presence of the peripheral unit and can be accurately driven out of the printer and positioned on the peripheral unit.

(3) Even when the center of an image to be perforated and that of the paper transport path are deviated from each other, the deviation can be readily corrected if the original position of image data stored in control means capable of electrically shifting the ink drum in the widthwise direction of a paper is electrically shifted. This successfully brings the center of a document image and that of a printed image into coincidence.

Various modifications will become possible for those skilled in the art after receiving the teachings of the present disclosure without departing from the scope thereof.

What is claimed is:

1. A stencil printer, comprising:

a multistage paper feeding device including a plurality of paper stocking portions and configured to selectively feed a plurality of different kinds of papers;

a master having an image;

an ink drum mounted within said stencil printer and shiftable in a direction perpendicular to a direction of conveyance of the papers by a motor, said ink drum being configured to receive said master; and a paper discharge tray configured to stack the papers each carrying a printed image thereon, wherein:

said plurality of paper stocking portions each including at least a pair of side fences configured to position the papers in a widthwise direction of the papers;

said paper discharge tray including at least a pair of side fences configured to position the papers carrying printed images thereon in the widthwise direction of the papers;

said plurality of paper stocking portions and said paper discharge tray being arranged in said stencil printer with center lines thereof coinciding with a center line of a paper transport path;

said side fences of said paper discharge tray being interlocked to each other and movable in the widthwise direction of the papers symmetrically to each other with respect to the center line of the paper transport path;

said side fences of each of said plurality of paper stocking portions are interlocked to each other and movable in the widthwise direction of the papers symmetrically to each other with respect to the center line of the paper transport path; and said stencil printer further comprises:

paper size sensing means for sensing sizes of the papers stacked on said plurality of paper stocking portions; and side fence moving means for moving said side fences of said paper discharge tray in accordance with the size of the papers selected.

2. A stencil printer as claimed in claim 1, further comprising a peripheral unit operatively connected to said stencil printer with a center line of a paper transport path thereof coinciding with center lines of said plurality of paper stocking portions or a center line of said paper discharge tray.

3. A stencil printer as claimed in claim 1, wherein said ink drum is configured such that an original position of said ink drum is electrically corrected to thereby correct a deviation when a center of the image formed in the master and the center of the paper transport path are deviated from each other.

* * * * *

UNITED STATES PATENT AND TRADEMARK OFFICE

CERTIFICATE OF CORRECTION

PATENT NO. : 6,401,606 B1
DATED : June 11, 2002
INVENTOR(S) : Mitsuo Sato

It is certified that error appears in the above-identified patent and that said Letters Patent is hereby corrected as shown below:

Column 1,
Line 15, please insert -- with the -- before “image”.

Column 3,
Line 25, please change “socking” to -- stocking --.

Column 5,
Line 46, please change “damper” to -- clamper --; and
Line 50, please change “damper” to -- clamper --.

Column 9,
Line 32, please change “camper” to -- clamper --;
Lines 43 and 47, please change “damper” to -- clamper --; and
Line 48, please change both occurrences of “damper” to -- clamper --.

Column 14,
Line 2, please change “, A a” to -- Δ α --.

Signed and Sealed this

Eleventh Day of March, 2003

JAMES E. ROGAN
*Director of the United States Patent and Trademark Office*